US005103809A

United States Patent [19]

DeLuca et al.

[11] Patent Number: 5,103,809

[45] Date of Patent: Apr. 14, 1992

[54] MASSAGING DEVICE

[76] Inventors: Pierre DeLuca, 453 Beechwood, Rosemere, Quebec, Canada, J7A 2B1; Milan Marzotto, 1441 Bord de l'Eau, Ste-Dorothee, Quebec, Canada, H7Y 1C5

[21] Appl. No.: 622,594

[22] Filed: Dec. 5, 1990

[51] Int. Cl.[5] ..... A61H 7/00

[52] U.S. Cl. ..... 128/60; 128/59; 128/61; 128/44; 128/56

[58] Field of Search ..... 128/32, 44, 56, 59, 128/60, 61, 35, 36, 24.2

[56] References Cited

U.S. PATENT DOCUMENTS

| | | | |
|---|---|---|---|
| 1,931,849 | 10/1933 | Matson | 128/56 |
| 4,526,163 | 7/1985 | Fedders | 128/56 |
| 4,632,095 | 12/1986 | Libin | 128/60 X |
| 4,633,858 | 1/1987 | Rutsch et al. | 128/59 |
| 4,733,655 | 3/1988 | Smal | 128/61 |
| 4,846,159 | 7/1989 | Antai et al. | 128/44 X |

*Primary Examiner*—Robert A. Hafer
*Assistant Examiner*—Brian E. Hanlon
*Attorney, Agent, or Firm*—Shlesinger, Arkwright & Garvey

[57] ABSTRACT

A massaging device has interchangeable heads which provide a deep muscular petrissage, and a deep transverse or circular friction. The device has a variable speed power drive, a transmission and a receptacle handle with a snap connector for replaceable massage heads. One of the massage heads connects to the snap connector and has a number of substantially similar cylindrical fingers made of resilient material, protruding from a disc portion, evenly spaced apart in a circle about the axis of rotation, and a straight sided finger in the center of the circle. Another massage head has a non-rotatable disc portion with at least two rotatable eccentric cylindrical fingers made of resilient material, the fingers evenly spaced from the axis of rotation and a connection to the drive to rotate the tips of the fingers in counter rotating directions.

9 Claims, 2 Drawing Sheets

MASSAGING DEVICE

The present invention relates to a massaging device and more particularly to a massaging device with replaceable heads having rotating fingers to perform deep muscle massage.

There are many types of massaging machines Some of these use a vibration technique which is satisfactory for a surface massage, but this technique 10 rarely provides a deep muscular petrissage or kneading. Deep muscular petrissage promotes muscle decontraction by a direct stretching action. It also promotes better circulation by helping ring out the metabolic by-products and waste materials forcing quicker venous evacuation, thus facilitating arterial blood flow which in turn accelerates tissue regeneration.

The present invention provides a variable speed massaging device which has a remote mechanical power drive with a flexible extension shaft leading to a receptacle handle. This handle is adaptable for taking different types of massage heads, one of the massage heads provides a deep muscular petrissage and a deep transverse friction. Another type of head provides a deep circular friction.

Deep transverse friction in muscular lesions is used to mobilize the muscle, i.e. to separate the adhesions formed by the scar tissue between individual muscle fibers. The most potent form of massage is deep friction according to J. H. Cyriax in his published medical book entitled, "Textbook of Orthopaedic Medicine". Deep friction massage can reach structures far below the surface of the body, it assists in breaking down adhesions, promotes absorption of effusion and the relief of stasis.

The present invention provides in a massaging device having a variable speed power drive means, a receptacle handle with rotatable connection means for a replaceable massage head, and flexible extension shaft joining the power drive means to the rotatable connection means in the receptacle handle, the improvement of a replaceable massage head comprising:

a rotatable disc portion having engagement means to the rotatable connection means in the receptacle handle, the rotatable disc portion having a plurality of substantially similar cylindrical fingers with semi-spherical ends protruding from the disc portion in a circle about an axis of rotation of the disc portion, the cylindrical fingers evenly spaced apart about the circle, a central finger protruding from the disc portion at the axis of rotation, said central finger including a side wall comprised of a plurality of generally flat areas extending along a longitudinal axis of said central finger and disposed at an angle one relatively to the other, the fingers formed of resilient material.

In another embodiment, the replaceable massage head comprises a non-rotatable disc portion with lock connection means to the receptacle handle, at least two massage fingers, each massage finger including a rotatable eccentric pin and a non-rotating sheath of resilient material over said eccentric pin, whereby rotation of said eccentric pin causes said sheath to deform in a circular motion without producing a rotation of the surface thereof, said replaceable massage head further comprising a drive to rotate the eccentric pins of the massage fingers in counter-rotating direction, said drive having engagement means to the rotatable connection means in the receptacle handle.

In drawings which illustrate embodiments of the invention:

Figure 1:
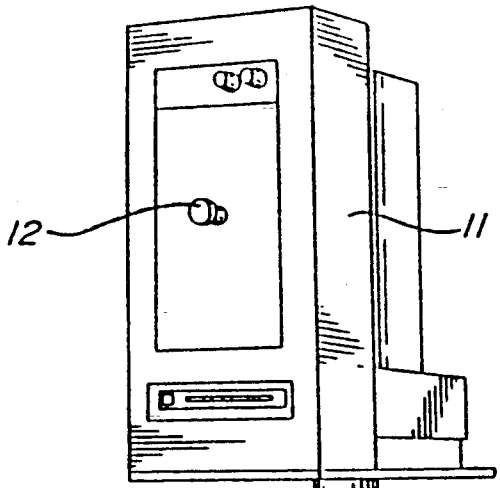
FIG. 1 is an isometric view showing one embodiment of the massaging device according to the present invention with one type of massage head fitted thereto.

Referring now to the drawings, in one embodiment a massaging device 10 comprises a power head 11 having a variable speed electric motor and gear box with a speed control knob 12 for varying speed of the unit. The power head 11 may be attached to the ceiling either by a rail so that it moves from one side of the room to another, or alternatively, may be on a swinging arm attached either to the wall or to a stand. In this manner, the power head 11 is placed high up in a room generally above a table, bed or the like, where a person is receiving treatment.

Figure 2:
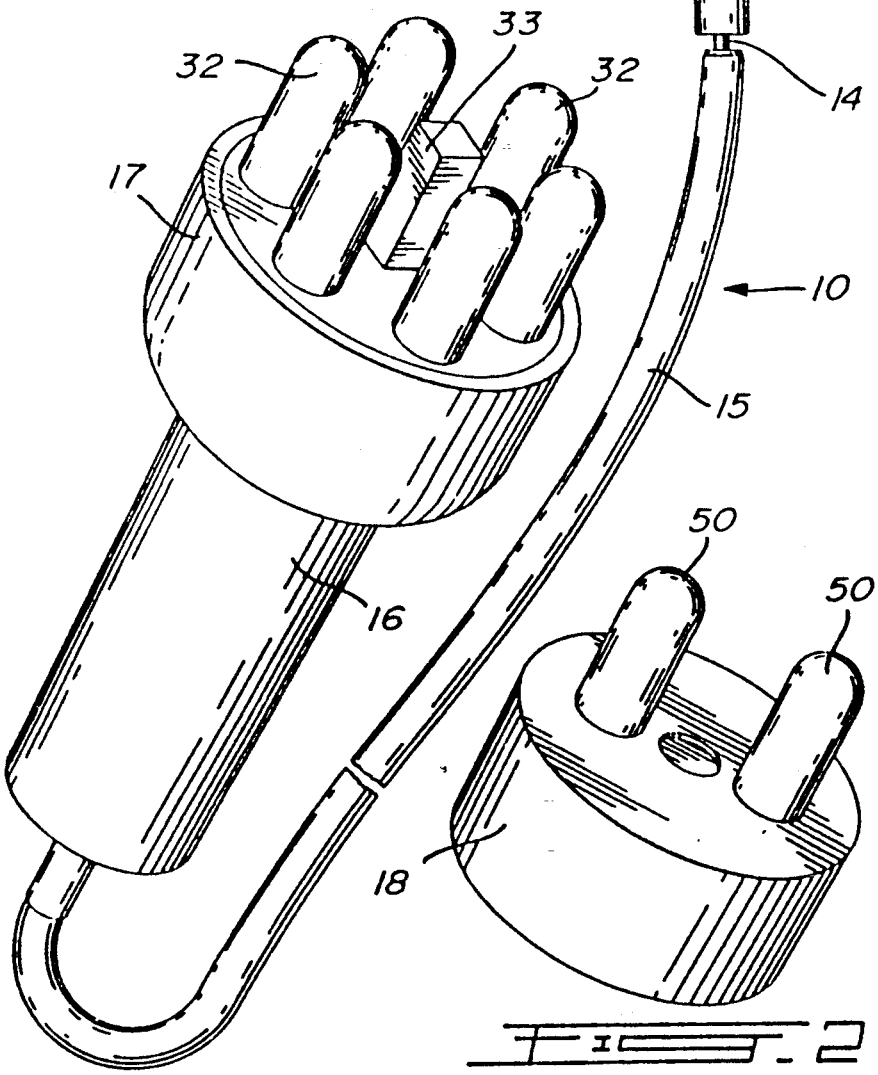
FIG. 2 is an isometric view showing another type of replaceable massage head.

The power head 11 has a connection 14 to a flexible extension shaft 15. The shaft 15 connects to a custom molded receptacle handle 16. A first replaceable massage head 17 is shown in FIG. 1 mounted to the receptacle handle 16 and a second replaceable massage head 18 is shown in FIG. 2. Whereas two types of replaceable heads 17 and 18 are shown, it will be apparent that other types of heads may be supplied for attachment to the receptacle handle 16.

Figure 3:
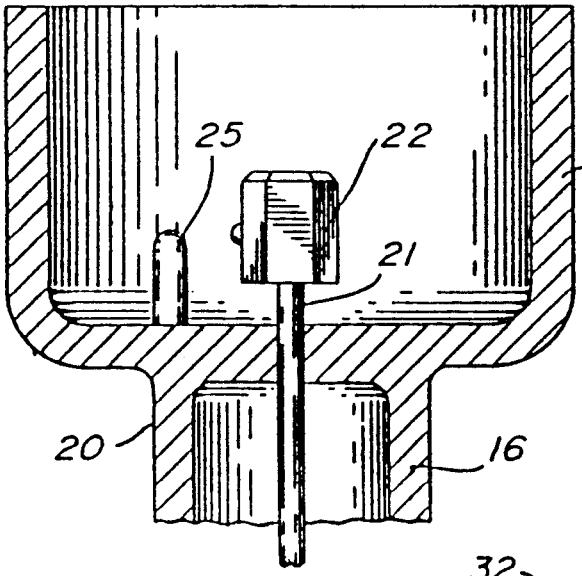
FIG. 3 is a partial sectional longitudinal view through the receptacle handle shown in FIG. 1.

Details of the receptacle handle 16 are shown in FIG. 3, the handle portion 20 is hollow having a shaft 21 extending down the center and ending in a connecting drive plug 22 with straight sides and a spring held ball for snap connection to a socket. The receptacle handle 16 has a hollow cylindrical end portion 24 with an engagement pin 25 for engagement with the second replaceable massage head 18. When the massage head 17 or 18 is snapped into the hollow cylindrical end portion 24 of the receptacle handle 16, the end of the massage head is flush with the cylindrical end portion 24 as illustrated in FIG. 1.

Figure 4:
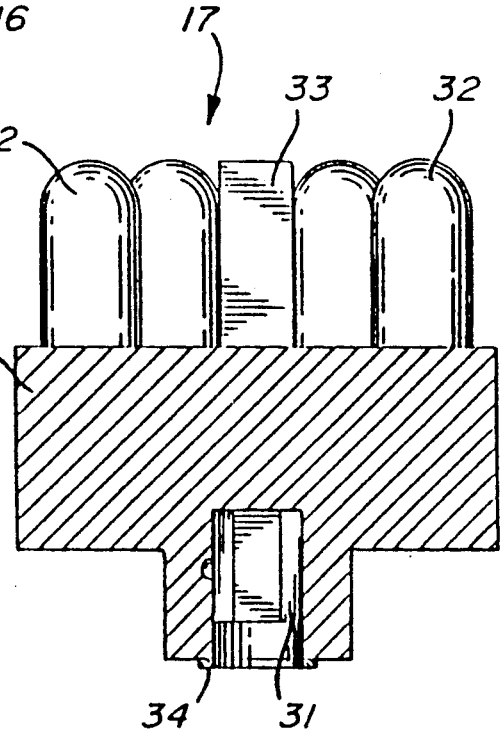
FIG. 4 is a sectional longitudinal view through the massage head shown in FIG. 1.

The first replaceable massage head 17 is shown in FIG. 4 and described as the deep muscular petrissage head. A cylindrical disc 30 fits into the cylindrical end portion 24 of the receptacle handle 16. A drive socket 31 extends inwards from the disc 30 and is rigidly attached to the cylindrical disc 30. The drive socket 31 fits over the connecting plug 22 having a detent to engage the spring held ball to provide a positive connection so that when the shaft 21 in the handle 16 rotates, the circular disc 30 also rotates. There is a space left free for the disc 30 to rotate and not engage the engagement pin 25 in the end portion 24. A guide ring 34 is provided at the base of the drive socket housing 31 to rub on the inside surface of the hollow end portion 24 of the handle 16. On the surface of the cylindrical disc 30 six substantially similar protruding cylindrical fingers 32 with semi-spherical ends are positioned equidistant apart in a circle about the axis of rotation of the cylindrical disc 30. The protruding fingers 32 are made of resilient material such as rubber and in one embodiment are an inch in diameter extending for two inches from the surface of the disc 30. In the center of the disc 30, protruding outwards, is a center finger 33 which is substantially square and also made of resilient material. Whereas the center finger 33 is shown as being square, it may be triangular or rectangular, provided it has flat sides. In the embodiment illustrated, the center finger 33 is the same length as the cylindrical fingers 32, but may be either slightly longer or shorter. The purpose of the flat surface on the center finger 33 is to provide a pinching action to the muscles between the cylindrical fingers 32 and the flat surface of the center finger 33. Whereas six cylindrical fingers 32 are illustrated, this number may be more or less depending upon the massage requirements.

Figure 5:
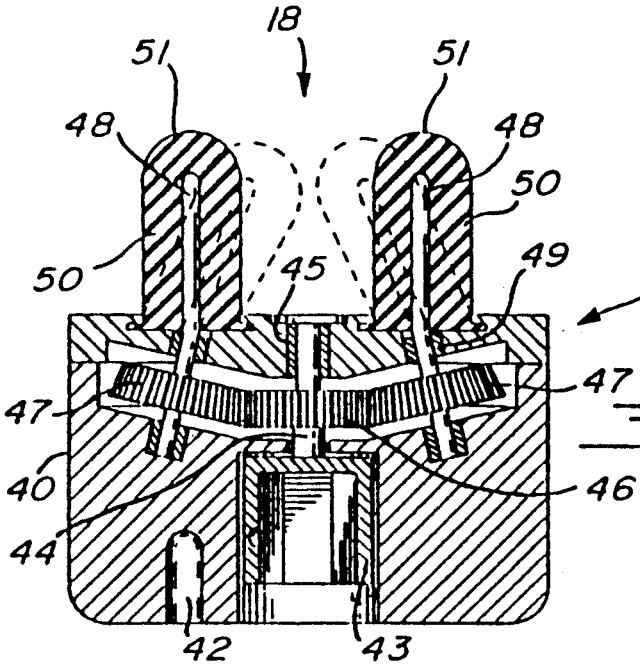
FIG. 5 is a sectional longitudinal view through the massage head shown in FIG. 2.

The second replaceable massage head 18 is shown in FIG. 5 and has a cylindrical disc 4, which fits into the cylindrical end portion 24 of the handle 16. An engagement aperture 42 is provided to line up and engage the engagement pin 25 in the end portion 24 in the handle 16 so that when the replaceable head 18 is fitted to the handle 16, the cylindrical disc 40 cannot rotate, and is locked to the handle. A drive socket 43 is mounted on a shaft 44 and positioned in the center interior of the circular disc 40 for connection to the connecting plug 22 in the end portion 24 of the handle 16. The shaft 44 is mounted on bearings 45 so that it rotates within the circular disc 40 and has a pinnion gear 46 engaging two separately mounted bevel gears 47 on each side of the center axis each having an axis of rotation tilting inwards. The separately mounted bevel gears 47 are each connected to an eccentric pin 48 which extends through a bearing 49 to protrude from the surface of the circular disc 40. Each eccentric pin 48 is located within a cylindrical finger 50 attached to the surface of the circular disc 40 such that when the eccentric pin 48 rotates, the tip 51 of the finger 50 rotates in a circle whereas the base of the finger is stationary. In the embodiment shown, the finger 50 is a sheath with the eccentric pin 48 rotating within the sheath so that the surface of the sheath does not rotate, but the tip 50 is deformed in a circular motion. As can be seen in FIG. 5, the drive mechanism is similar to that of an egg beater, the eccentric pins 48 are counter rotating and when used as a massage provide deep circular friction.

In one embodiment the fingers are one half in diameter and spaced about one inch apart at the disc portion. The two fingers 50 tilt inwards, so the distance between the fingers at the tips 51 is about three quarters of an inch without taking into account the eccentricity. The tips 51 have an eccentric rotation of approximately one quarter inch diameter. In both cases, the speed of the device may be varied by the speed control knob 12 on the power head 11. In the case of the second replaceable massage head 17, the fingers 50 are formed of resilient material to allow the eccentric pin 48 to rotate within.

The materials of construction are preferably aluminum or hard plastic for the circular discs 30 and 40 of both replaceable massage heads 17 and 18.

Various changes may be made to the embodiments shown herein without departing from the scope of the present invention which is limited only by the following claims.

The embodiments of the invention in which an exclusive property or privilege is claimed are defined as follows.

1. In a massaging device having a variable speed power drive means, a receptacle handle with rotatable connection means for a replaceable massage head, and a transmission joining the power drive means to the rotatable connection means in the receptacle handle, the replaceable massage head comprising:

a rotatable disc portion having engagement means to the rotatable connection means in the receptacle handle, the rotatable disc portion having a plurality of substantially similar cylindrical fingers with semi-spherical ends protruding from the disc portion in a circle about an axis of rotation of the disc portion, the cylindrical fingers evenly spaced apart about the circle, a central finger protruding from the disc portion at the axis of rotation, said central finger including a side wall comprised of a plurality of generally flat areas extending along a longitudinal axis of said central finger and disposed at an angle one relatively to the other, the fingers formed of resilient material.

2. A massaging device having a variable speed power drive means, a receptacle handle with rotatable connection means for a replaceable massage head, and a transmission joining the power drive means to the rotatable connection means in the receptacle handle, the device comprising:

a rotatable disc portion having means for engagement to the rotatable connection means in the receptacle handle, the rotatable disc portion having a plurality of substantially similar cylindrical fingers with semi-spherical ends protruding from the disc portion in a circle about an axis of rotation of the disc portion, the cylindrical fingers evenly spaced apart about the circle, a central finger protruding from the disc portion at the axis of rotation, said central finger including a side wall comprised of a plurality of generally flat areas, extending a long a longitudinal axis of said central finger and disposed at an angle one relatively to the other, the fingers formed of resilient material; and a non-rotatable disc portion with lock means for connecting to the receptacle handle, at least two massage fingers, each massage finger including a rotatable eccentric pin and a non-rotating sheath of resilient material over said eccentric pin, whereby rotation of said eccentric pin causes said sheath to deform in a circular motion without producing a rotation of the surface thereof, said replaceable massage head further comprising a drive to rotate the eccentric pins in counter-rotating direction, said drive having engagement means to the rotatable connection means in the receptacle handle.

3. The massaging device according to claim 1 or claim 2 wherein said central finger has a square cross section.

4. The massaging device according to claim 1 or claim 2 wherein said central finger has a triangular cross section.

5. The massaging device according to any of claims 1 or 2 wherein the rotatable connection means in the receptacle handle and the engagement means for the replaceable massage head comprises a male and female snap socket connection.

6. The massaging device according to claim 2 wherein the massage fingers are each about one half inch in diameter, and spaced apart about one inch at the disc portion.

7. The massaging device according to claim 2 wherein each eccentric pin has an axis of rotation tilting inwards.

8. The massaging device according to claim 7 wherein the tip of the eccentric pin has a rotation diameter of approximately one quarter inch.

9. The massaging device according to claim 8 wherein the massage fingers are spaced apart about one inch at the disc portion.

* * * * *